US011236574B2

(12) United States Patent
Cook et al.

(10) Patent No.: US 11,236,574 B2
(45) Date of Patent: Feb. 1, 2022

(54) SUBSEA ASSIST SNUBBING JACK

(71) Applicant: Oceaneering International, Inc., Houston, TX (US)

(72) Inventors: John R. Cook, Kingwood, TX (US); Robert L. Ewen, Cypress, TX (US); Harris Akhtar Iqbal, Porter, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 17/076,086

(22) Filed: Oct. 21, 2020

(65) Prior Publication Data

US 2021/0140261 A1 May 13, 2021

Related U.S. Application Data

(60) Provisional application No. 62/924,048, filed on Oct. 21, 2019.

(51) Int. Cl.
*E21B 19/08* (2006.01)
*E21B 33/035* (2006.01)
*E21B 33/076* (2006.01)

(52) U.S. Cl.
CPC ..... *E21B 33/076* (2013.01); *E21B 19/08* (2013.01); *E21B 33/0355* (2013.01)

(58) Field of Classification Search
CPC ..... E21B 19/08; E21B 19/22; E21B 33/0355; E21B 33/076
See application file for complete search history.

(56) References Cited

U.S. PATENT DOCUMENTS

| | | | | |
|---|---|---|---|---|
| 5,732,909 | A * | 3/1998 | Sonnier | E21B 19/07 166/209 |
| 7,314,087 | B2 * | 1/2008 | Robichaux | E21B 19/006 166/352 |
| 7,431,092 | B2 * | 10/2008 | Haheim | E21B 19/22 166/343 |
| 8,573,312 | B2 * | 11/2013 | Sonnier | E21B 19/00 166/382 |
| 8,720,582 | B2 * | 5/2014 | Portman | E21B 19/22 166/348 |
| 8,863,846 | B2 * | 10/2014 | Overstreet | E21B 19/086 166/338 |
| 9,822,613 | B2 * | 11/2017 | Crawford | E21B 19/09 |
| 9,970,243 | B2 * | 5/2018 | Still | E21B 19/002 |
| 2008/0053661 | A1 * | 3/2008 | Funk | E21B 19/24 166/380 |
| 2016/0245026 | A1 * | 8/2016 | Newman | E21B 19/086 |

* cited by examiner

*Primary Examiner* — Matthew R Buck
(74) *Attorney, Agent, or Firm* — Maze IP Law, P.C.

(57) ABSTRACT

A subsea assist snubbing jack comprises bi-directional slip bowls and can hold light or heavy pipe loads, create clamping load internally without relying on pipe weight or the force of the subsea assist snubbing jack to develop clamping force; do not require pipe motion to unseat the clamp on the pipe; utilize smooth faced inserts that do not mark the pipe; and are suitable for subsea control by wire operation. In embodiments, it is also instrumented to directly measure the pipe weight being held by one or both slip bowls.

18 Claims, 3 Drawing Sheets

SUBSEA ASSIST SNUBBING JACK

RELATION TO OTHER APPLICATIONS

This application claims priority through U.S. Provisional Application 62/924,048 filed on Oct. 21, 2019.

BACKGROUND

Snubbing units were primarily designed to work in well control situations to "snub" drill pipe and or casing into, or out of, a well bore when conventional well killing methods could not be used. Unlike conventional drilling and completions operations, snubbing can be performed with the well still under pressure (not killed). When done so, it is called hydraulic workover which can also be performed without having to remove the Christmas tree from the wellhead.

Typically, a minimum of four slip bowls are used in snubbing operations. Two slip bowls are designated for "pipe light" operations, ones where the well bore forces are greater than the tubular weight in the well bore. The other two slip bowls are designated for "pipe heavy" operation, one which occur when, e.g., enough pipe has been snubbed into the well bore and fluid weight inside of the pipe is greater than the snub forces acting against the pipe in the well bore. Traditional slip bowls can only hold pipe load in one direction, require jack force or pipe weight to generate clamping force, require reversed pipe motion to unseat the clamp on the pipe, have no method of measuring the pipe weight being held by the slip bowl, rely on serrated toothed inserts that mechanically bite and mark the pipe, and are not used subsea.

In addition, traditional snubbing jacks are not used subsea, use hydraulic power to drive hydraulic jacking cylinders, use mechanical and/or hydraulic interlocks, and do not have leg motion misalignment measurement and control, relying instead on equalizing pressure across cylinders. Further, traditional snubbing jacks use hydraulic circuits to control jack leg and slip bowl, use hydraulic power to drive hydraulic jacking cylinders, use mechanical and/or hydraulic interlocks, and do not have leg motion misalignment measurement and control, relying instead on equalizing pressure across cylinders.

However, using direct hydraulic drive is not practical in deeper water; very high pressure is required or heavy walled cylinders, high hysteresis circuit losses leading to poor system response

FIGURES

Various figures are included herein which illustrate aspects of embodiments of the disclosed inventions.

DESCRIPTION OF EXEMPLARY EMBODIMENTS

Figure 2:
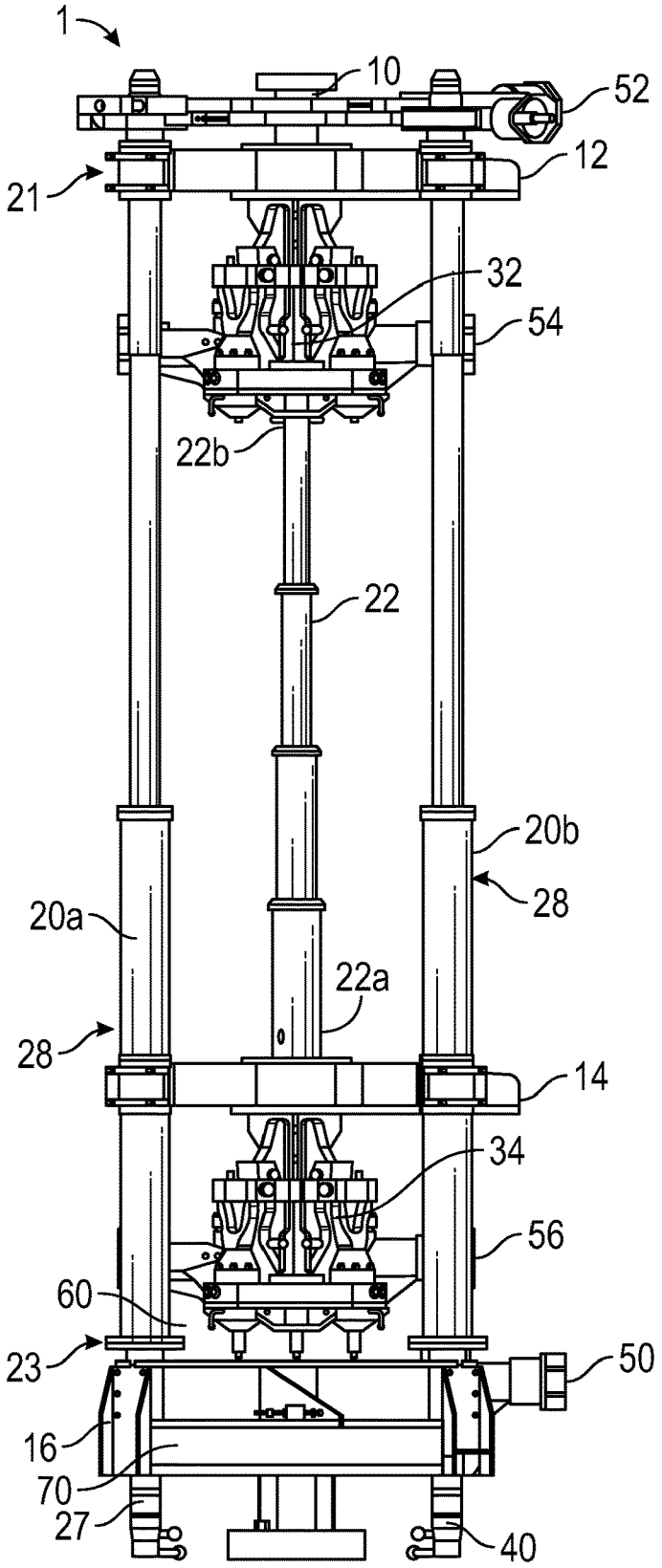
FIG. 2 is a plan view in partial perspective of an embodiment of a subsea assist snubbing jack.
Figure 3:
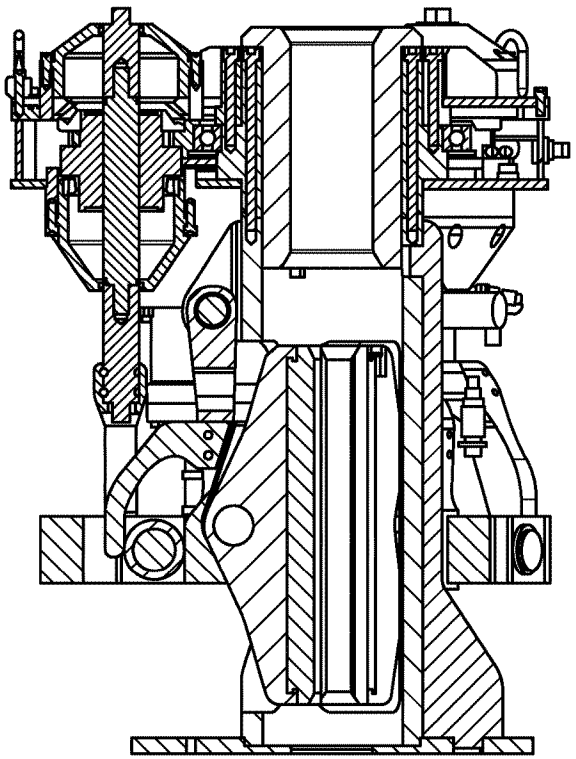
FIG. 3 is a plan view in partial perspective of an embodiment of a subsea assist snubbing jack slip in a closed position.

Generally, referring generally to FIG. 2, subsea assist snubbing jack 1 is typically configured to not require pipe motion to unseat subsea assist snubbing jack 1 on a pipe and to be used without a need for serrated toothed inserts that mechanically bite and mark a pipe.

In a first embodiment, still referring generally to FIG. 2, subsea assist snubbing jack 1 comprises a plurality of jack legs, generally referred to herein as callout 20 with exemplary ones as 20*a*, 20*b*; one or more leg actuators 28 operatively connected to a predetermined set of jack legs of the plurality of jack legs 20; first slip bowl 34 disposed at least partially within the plurality of jack legs 20; second slip bowl 32 movingly disposed at least partially within the plurality of jack legs 20 distally from first slip bowl 34 where second slip bowl 32 is operatively connected to the plurality of jack legs 20; control system 80 (FIG. 1) operatively in communication with leg actuator 28 operatively in communication with the plurality of jack legs 20, first slip bowl 34, and second slip bowl 32 and software operative to adjust each leg 20*a*, 20*b* and leg pair of the plurality of jack legs 20 to ensure that pipe 116 (FIG. 1) is being snubbed into well 200 (FIG. 1) concentrically.

In embodiments, two jack legs 20*a*, 20*b* of the plurality of jack legs 20 are disposed diagonally with respect to each other and the diagonally disposed pair of jack legs 20 are configured to perform redundantly in that either diagonal pair 20*a*, 20*b* can perform a desired snubbing operation and either can be disengaged while still in operation on the well should there be a jack leg failure. In certain of these embodiments, the diagonally disposed pair of jack legs 20 is configured to be disengaged while still in operation on the well should there be a jack leg failure of one of the diagonally disposed pair of jack legs.

In most configurations, first slip bowl 34 and second slip bowl 32 can hold light or heavy pipe loads and are adapted to create a clamping load internally, do not rely on pipe weight or the force of the subsea jack to develop clamping force, and do not require pipe motion to unseat the clamp on the pipe. Typically, at least one of first slip bowl 34 and second slip bowl 32 can traverse bi-directionally within the plurality of jack legs 20. Typically, first slip bowl 34 is fixed within the plurality of jack legs 20 and second slip bowl 32 travels within the plurality of jack legs 20 such as by having second slip bowl 32 slidingly connected to the plurality of jack legs 20. Where second slip bowl 32 is slidingly connected, traveling bracket 52 may be present and connected to first end 21 of the plurality of jack legs 20 and to second slip bowl 32 and fixed bracket 14 connected to second end 23 of the plurality of jack legs 20 distally from traveling bracket 52 and to first slip bowl 34.

Figure 4:
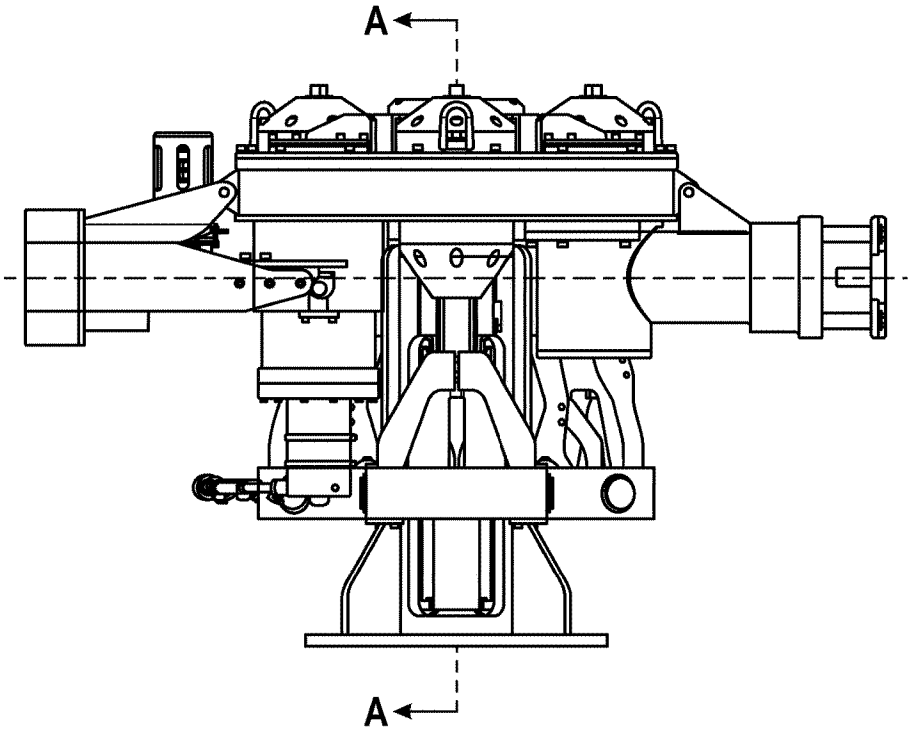
FIG. 4 is a block diagram of an exemplary actuator.
Figure 4:
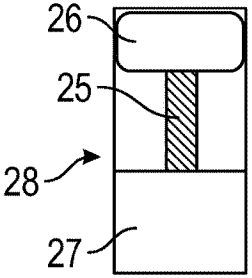

Referring additionally to FIG. 4, leg actuator 28 is typically powered by or otherwise comprises a subsea electric motor such as electric motor 27 and may comprises a set of actuators, each leg actuator 28 of the set of actuators operatively connected to a corresponding jack leg 20 of the predetermined set of jack legs 20. In an embodiment, leg actuator 28 comprises power screw 25, nut 26 cooperatively in communication with power screw 25, and motor 27 operatively in communication with power screw 25 and adapted to provide power to power screw 25.

Referring back to FIG. 2, subsea assist snubbing jack 1 typically further comprises telescoping guide 22 disposed within the plurality of jack legs 20 where telescoping guide 22 is in communication with first slip bowl 34 and second slip bowl 32. Telescoping guide 22 comprises first end 22*a* connected to first slip bowl 34 and second end 22*b* connected to second slip bowl 32.

Figure 1:
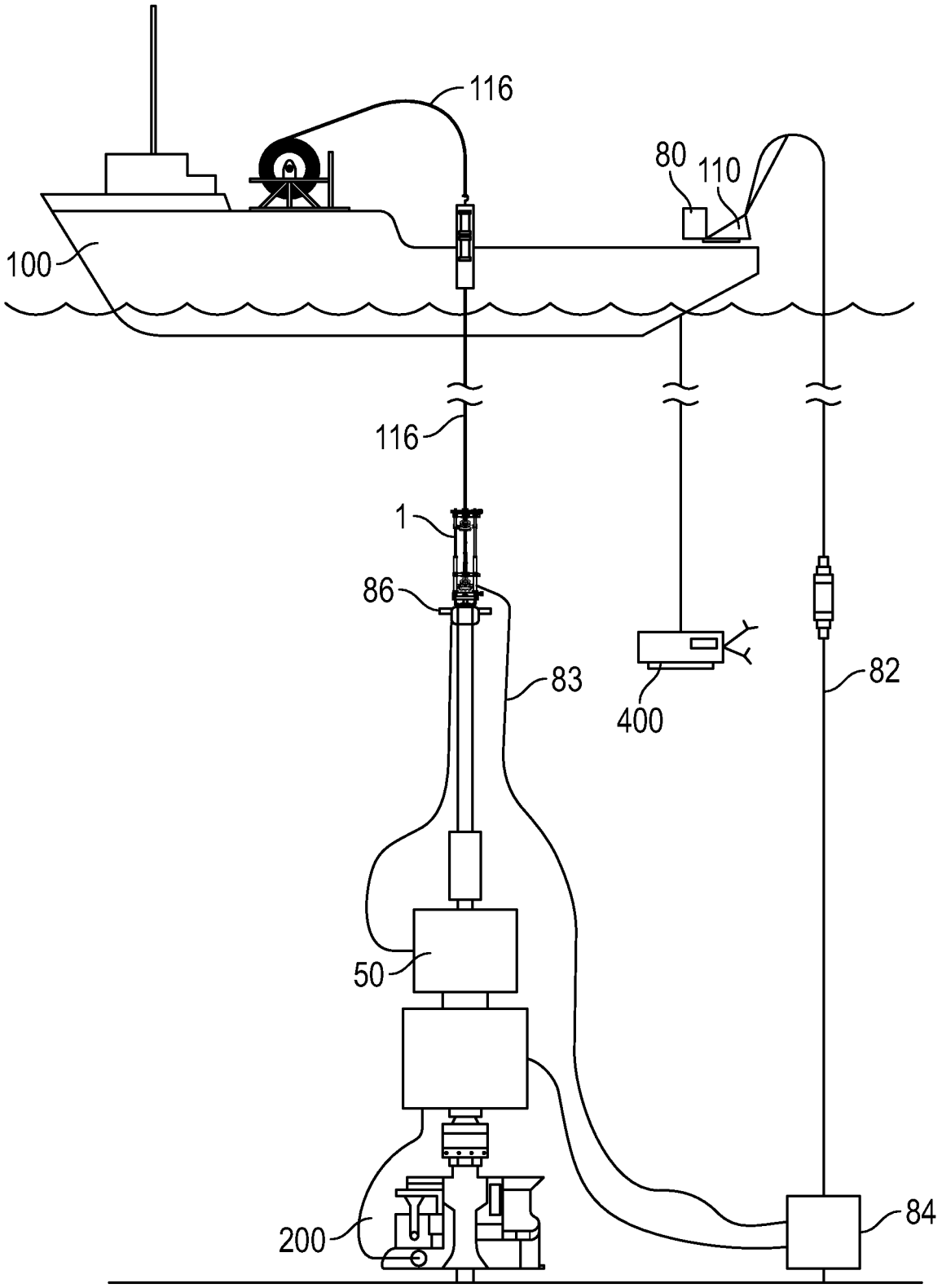
FIG. 1 is a general overview of an exemplary system.

Referring now to FIG. 1, control system 80 may comprise a monitor (not shown in the figures) and, in an embodiment, may be located subsea at or proximate to subsea assist snubbing jack 1 if there is a requirement for high response times, e.g. where lag time for surface communications is too large. Control system 80 may further comprise an electrical control system, comprising electronic controller 84, software comprising a programmable motion sequencer adapted to respond to match current metocean conditions, and a set of programmed interlocks 86 to ensure that a pipe being snubbed is restrained. As used herein, metocean conditions are conditions related to the syllabic abbreviation of meteorology and physical oceanography.

Although illustrated as being deployed proximate well 200 and operatively connected to subsea assist snubbing jack via comm link 83, electronic controller 84 can be located proximate to, collocated with, or as part of control system 80 at a location that is not subsea.

Referring back to FIG. 2, in certain embodiments, subsea assist snubbing jack 1 further comprises one or more interfaces 12 adapted to communicate with a pipe handling system such as might be present on vessel 100 to control motion of the pipe through the water when required. Control system 80 may further be operatively in communication with one or more sensors 60 configured to directly measure pipe weight being held by first slip bowl 34 and/or second slip bowl 32.

In certain embodiments, subsea assist snubbing jack 1 further comprises one or more control interfaces 40 and control system 80 (FIG. 1) is further operatively in communication with remote controller 110 (FIG. 1) configured to provide subsea control by wire or wireless operation such as via control interface 40. In embodiments, control interface 40 is configured to provide an electrical interface to a subsea vehicle, e.g. remotely operated vehicle (ROV) 400 (FIG. 1) or an autonomous underwater vehicle (AUV) (not specifically shown in the figures but similar to ROV 400), to allow the subsea vehicle to at least partially control leg actuator 28 such as by effecting screw adjustment and drive.

Subsea assist snubbing jack 1 may further comprising a predetermined set of smooth faced inserts 70 that do not mark a pipe.

As one of ordinary skill in snubbing jack art can discern, using direct hydraulic drive is not practical in deeper water; the very high pressure required or heavy walled cylinders, high hysteresis circuit losses lead to poor system response. As can be discerned, subsea assist snubbing jack 1 can be used and is therefore practical for use in deeper water. In embodiments, subsea assist snubbing jack 1 uses power screw and "nut" system as a jack leg and use one or more subsea electric motors to power the screws.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A subsea assist snubbing jack, comprising:

a. a plurality of jack legs;

b. a leg actuator operatively connected to a predetermined set of jack legs of the plurality of jack legs, the leg actuator comprising a subsea electric motor;

c. a first slip bowl disposed at least partially within the plurality of jack legs;

d. a second slip bowl movingly disposed at least partially within the plurality of jack legs distally from the first slip bowl, the second slip bowl operatively connected to the plurality of jack legs;

e. a control system operatively in communication with the leg actuator, the control system comprising:

i. a monitor operatively in communication with the plurality of jack legs, the first slip bowl, and the second slip bowl; and ii. software operative to adjust each jack leg of the plurality of jack legs to ensure that a pipe is being snubbed into a well concentrically; and f. a predetermined set of smooth faced inserts that do not mark a pipe.

2. The subsea assist snubbing jack of claim 1, wherein:

a. two jack legs of the plurality of jack legs are disposed diagonally with respect to each other to define a diagonally disposed pair of jack legs, the diagonally disposed pair of jack legs configured to perform redundantly in that either diagonal pair can perform a desired snubbing operation and either can be disengaged while still in operation on the well should there be a jack leg failure; and b. the software is further operative to:

i. adjust each diagonally disposed leg pair of the plurality of jack legs to ensure that a pipe is being snubbed into a well concentrically;

ii. control a jack leg of the diagonally disposed pair of jack legs to perform a desired snubbing operation;

iii. determine if a jack leg of the diagonally disposed pair of jack legs fails; and iv. disengage the failing jack leg of the diagonally disposed pair of jack legs to while still in operation on the well.

3. The subsea assist snubbing jack of claim 2, wherein the diagonally disposed pair of jack legs is configured to be disengaged while still in operation on the well should there be a jack leg failure of one of the diagonally disposed pair of jack legs.

4. The subsea assist snubbing jack of claim 1, wherein the control system further comprises an electrical control system operatively in communication with the leg actuator and operatively in communication with the plurality of jack legs, the electrical control system comprising:

a. an electronic controller; and b. software comprising a programmable motion sequencer adapted to respond to match current metocean conditions; and c. a set of programmed interlocks to ensure that a pipe being snubbed is restrained.

5. The subsea assist snubbing jack of claim 1, further comprising an interface adapted to communicate with a pipe handling system on a vessel to control motion of the pipe through the water when required.

6. The subsea assist snubbing jack of claim 1, wherein at least one of the first slip bowl and the second slip bowl can traverse bi-directionally within the plurality of jack legs.

7. The subsea assist snubbing jack of claim 1, wherein the first slip bowl is fixed within the plurality of jack legs.

8. The subsea assist snubbing jack of claim 1, wherein the first slip bowl and the second slip bowl are adapted to create a clamping load internally and do not rely on pipe weight or the force of the subsea jack to develop clamping force.

9. The subsea assist snubbing jack of claim 1, wherein the snubbing jack is configured to not require pipe motion to unseat the subsea assist snubbing jack on a pipe.

10. The subsea assist snubbing jack of claim 1, wherein the control system is further operatively in communication with a sensor configured to directly measure pipe weight being held by either the first slip bowl or the second slip bowl.

11. The subsea assist snubbing jack of claim 1, wherein:

a. the subsea assist snubbing jack further comprises a control interface; and b. the control system is further operatively in communication with a remote controller configured to provide subsea control by wire operation via the control interface.

12. The subsea assist snubbing jack of claim 11, wherein the control interface is configured to provide an electrical interface to a subsea vehicle to allow the subsea vehicle to at least partially control the leg actuator of the subsea assist snubbing jack.

13. The subsea assist snubbing jack of claim 1, further comprising a telescoping guide disposed within the plurality of jack legs, the telescoping guide in communication with the first slip bowl and the second slip bowl.

14. The subsea assist snubbing jack of claim 13, wherein the telescoping guide comprises a first end connected to the first slip bowl and a second end connected to the second slip bowl.

15. The subsea assist snubbing jack of claim 1, wherein the second slip bowl is slidingly connected to the plurality of jack legs.

16. The subsea assist snubbing jack of claim 1, further comprising:

a. a traveling bracket connected to a first end of the plurality of jack legs and to the second slip bowl; and b. a fixed bracket connected to a second end of the plurality of jack legs, disposed distally from the traveling bracket, and to the first slip bowl.

17. The subsea assist snubbing jack of claim 1, wherein the leg actuator comprises a set of actuators, each leg actuator of the set of actuators operatively connected to a corresponding jack leg of the predetermined set of jack legs.

18. The subsea assist snubbing jack of claim 1, wherein the leg actuator comprises:

a. a power screw;

b. a nut cooperatively in communication with the power screw; and c. a motor operatively in communication with the power screw and adapted to power the power screw.

* * * * *